US005562158A

United States Patent [19]

Nishishita

[11] Patent Number: 5,562,158

[45] Date of Patent: Oct. 8, 1996

[54] MULTILAYERED HEAT EXCHANGER

[75] Inventor: Kunihiko Nishishita, Konan, Japan

[73] Assignee: Zexel Corporation, Tokyo, Japan

[21] Appl. No.: 327,499

[22] Filed: Oct. 21, 1994

[30] Foreign Application Priority Data

Oct. 22, 1993 [JP] Japan ..... 5-287632
Aug. 1, 1994 [JP] Japan ..... 6-199035

[51] Int. Cl.[6] ..... F28D 1/03

[52] U.S. Cl. ..... 165/153; 165/176; 165/DIG. 466; 165/DIG. 465

[58] Field of Search ..... 165/153, 176

[56] References Cited

U.S. PATENT DOCUMENTS 4,274,482 6/1981 Sonoda ..... 165/153
4,332,293 6/1992 Hiramastu ..... 165/153
4,589,265 5/1986 Nozawa ..... 62/526
5,024,269 6/1991 Noguchi et al. ..... 165/153
5,042,577 8/1991 Suzumura ..... 165/153
5,076,354 12/1991 Nishishita ..... 165/146

FOREIGN PATENT DOCUMENTS 0271084 6/1988 European Pat. Off. .
0360362 3/1990 European Pat. Off. .
2114340 5/1972 Germany .

*Primary Examiner*—Allen J. Flanigan
*Attorney, Agent, or Firm*—Wenderoth, Lind & Ponack

[57] ABSTRACT

With a fin width FW in the air-flow direction, fin thickness FT, fin pitch FP, fin height FH, and tube element height TW, dimensional relationships are 50 mm≦FW≦65 mm, 0.06 mm≦FT≦0.10 mm, 2.5 mm≦FP≦3.6 mm, 7.0 mm≦FH 9.0 mm, and 2.0 mm≦TW≦2.7 mm. Provided are an optimum fin shape and tube element thickness in which a heat exchange efficiency and an air-flow resistance are well balanced, thereby ensuring an improvement in the heat exchange efficiency and the reduction in size of the heat exchanger.

6 Claims, 6 Drawing Sheets

MULTILAYERED HEAT EXCHANGER

BACKGROUND OF THE INVENTION

1. Field of the Invention

The present invention relates generally to a multilayered heat exchanger consisting of a plurality of alternately layered fins and tube elements and, more particularly, to an improvement in dimensional relationships of the fins and tube elements.

2. Description of the Related Arts

In a heat exchanger having fins and tube elements alternately layered, a heat exchange medium flowing within the tube elements transfers its temperature to the fins, to exchange heat principally by way of the fins with air passing through the spaces defined between the adjacent tube elements. Heat exchangers of the type which have been hitherto manufactured by the present applicant had a fin width FW in the air-flow direction of 74 mm, fin thickness FT of 0.11 mm, fin pitch FP of 3.6 mm, fin height FH of 9.0 mm, and a tube element thickness TW of 2.9 mm. An investigation performed by the present applicant has revealed that for the products by the other manufacturers, the fin width FW in the air-flow direction lies within a range of 64 mm to 110 mm, the fin thickness FT in a range of 0.10 mm to 0.12 mm, the fin pitch FP in a range of 3.4 mm to 4.5 mm, the fin height FH in a range of 8.0 mm to 12.3 mm, and the tube element thickness TW in a range of 2.8 mm to 3.4 mm, which will cover the heat exchanger of the present applicant.

Although it is believed for the heat exchanger that its heat exchange efficiency can be improved by increasing contact areas between the fins and air, if the distances between the adjacent tube elements (or fin height) are increased to enlarge the surface areas of the fins, the heat exchange efficiency will be impaired. Also, if the distances between the adjacent tube elements are reduced to lessen the fin pitch, the air-flow resistance will be increased to impede the flow of air. Nevertheless, while considering not only the improvement in the heat exchange efficiency but also the reduction of the air-flow resistance, the demands to improve the performance of the heat exchanger and reduce the size thereof must be satisfied, which will need a still further improvement of the heat exchanger.

SUMMARY OF THE INVENTION

The present invention was conceived to overcome the above problems. It is therefore the object of the present invention to provide a multilayered heat exchanger in which dimensional conditions are optimized to improve the efficiencies, thereby realizing a reduction in size.

The present applicant has successfully found out optimum dimensional relationships for a fin width FW in the air-flow direction, fin thickness FT, fin pitch FP, fin height FH, tube element thickness TW in view of the fact that:

1) a smaller fin width in the air-flow direction will result in a reduction in size of the heat exchanger and less air-flow resistance, but in inferior heat exchange performance, whereas a greater fin width will lead to a superior heat exchange performance, but to an increased air-flow resistance;
2) a smaller fin thickness will result in less air-flow resistance, but in a lower heat exchange performance, whereas a greater fin thickness will lead to a higher heat exchange performance, but to an increased air-flow resistance;

3) a greater fin pitch will result in good draining property and less air-flow resistance but in a lowered heat exchange performance, whereas a smaller pitch will lead to a heightened heat exchange performance, but to an increased air-flow resistance;
4) a greater fin height will result in less air-flow resistance, but in a poor heat exchange performance, whereas a smaller height will lead to good heat exchange performance, but to an increased air-flow resistance; and
5) a smaller tube element thickness will result in less air-flow resistance, but in an increased passage resistance within the tube and hence a lowered heat exchange performance, whereas a greater thickness thereof will lead to less passage resistance within the tube, but to a narrower distance between the adjacent tube elements and hence an increased air-flow resistance.

Thus, according to the present invention, there is provided a multilayered heat exchanger comprising a plurality of alternately layered fins and tube elements, the tube elements each including a flow passage for a heat exchange medium, the fins and tube elements of the heat exchanger satisfying the relationships 50 mm≦FW≦65 mm, 0.06 mm≦FT 0.10 mm, 2.5 mm≦FP≦3.6 mm, 7.0 mm≦FH≦9.0 mm, and 2.0 mm≦TW≦2.7 mm, where FW represents a width of the fin in the air-flow direction, FT a thickness of the fin, FP a pitch of the fin, FH a height of the fin, and TW a thickness of the tube element.

Such configurations will ensure optimum dimensional relationships in the width, thickness, pitch, and height of the fin, and in the tube element thickness, thereby providing an optimum heat exchanger in which the heat exchange performance and the air-flow resistance are well balanced, and improving the heat exchange efficiency to accordingly reduce the size of the heat exchanger.

BRIEF DESCRIPTION OF THE DRAWINGS

These and other advantages, features and objects of the present invention will be understood by those of ordinary skill in the art referring to the annexed drawings, given purely by way of non-limitative example, in which.

DETAILED DESCRIPTION OF THE PREFERRED EMBODIMENT

An exemplary embodiment of the present invention will now be described with reference to the accompanying drawings.

Figure 1A:
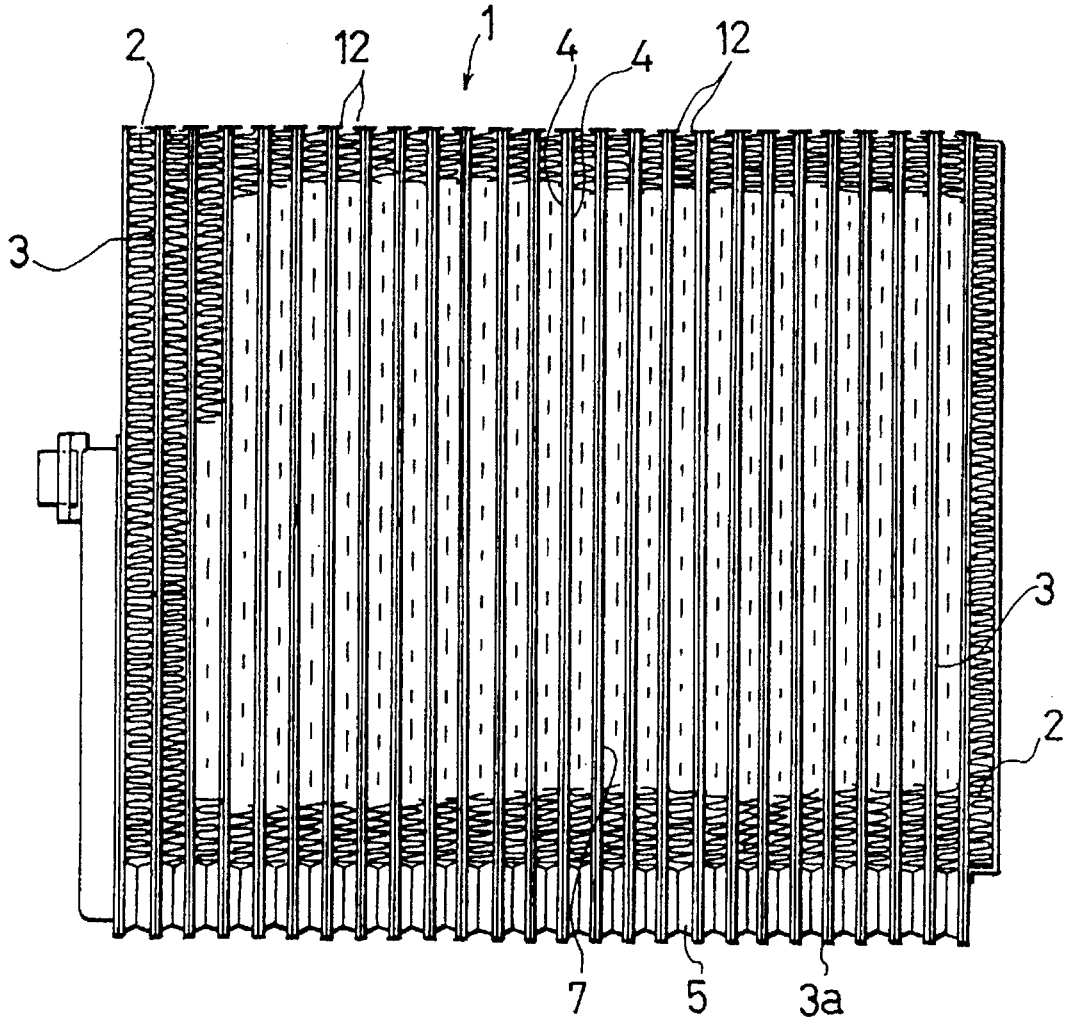
FIGS. 1A and 1B are a front elevational view and a bottom plan view, respectively, of a multilayered heat exchanger constructed in accordance with the present invention.
Figure 1B:
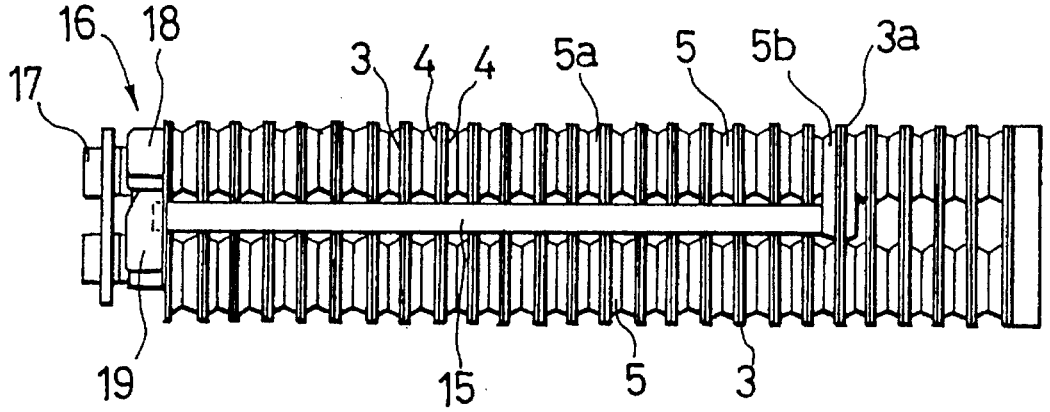

Referring first to FIG. 1, a multilayered heat exchanger generally designated at 1 is in the form of, for example, a four-path type evaporator comprising a plurality of fins 2 and tube elements 3 alternately layered with a plurality of tanks 5 disposed, for example, only on its one side. Each of the tube elements 3 consists of a couple of molded plates 4 joined together at their peripheries, and includes at one end thereof two tanks 5 respectively arranged upstream and downstream of the air-flow. Each of tube elements 3 further includes a heat exchange medium passage 7 through which the heat exchange medium flows, the passage 7 extending from the tanks 5 toward the other end.

Figure 2:
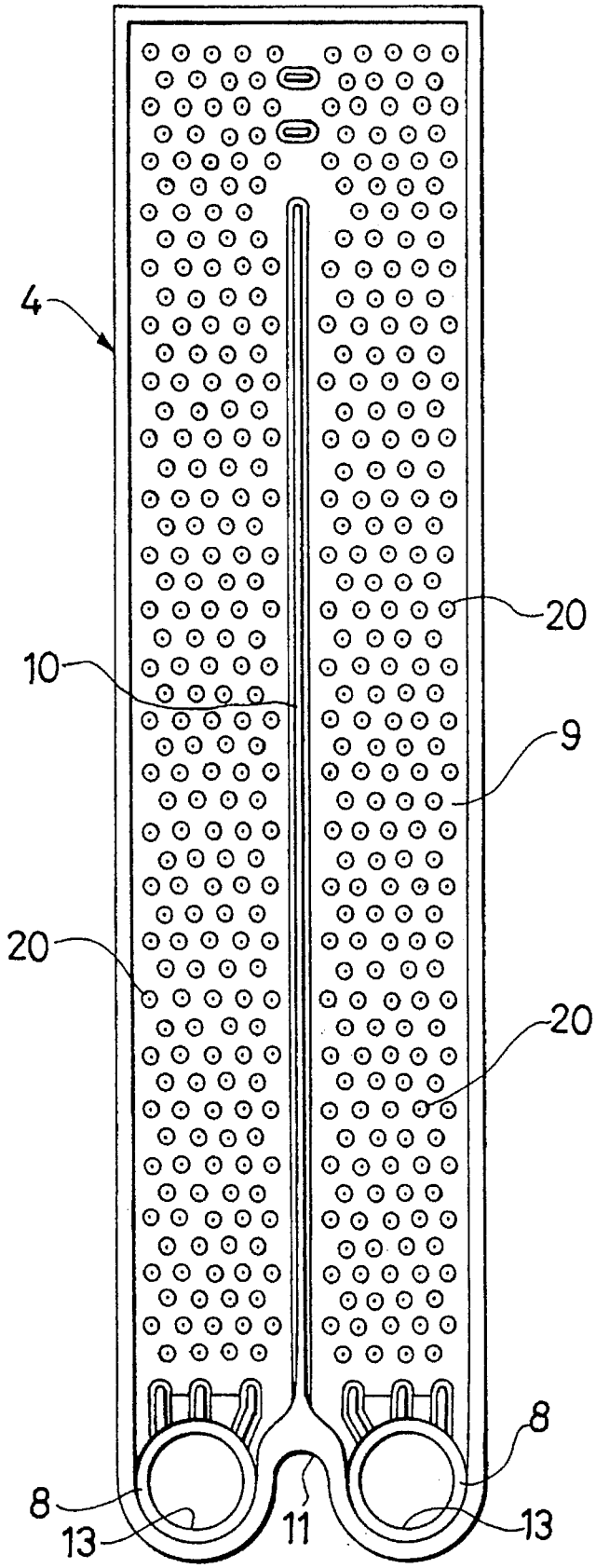
FIG. 2 is a front elevation of a molded plate constituting a tube element for use in the multilayered heat exchanger shown in FIG. 1.

The molded plate 4 is obtained by pressing an aluminum plate having a thickness of 0.25 mm to 0.45 mm, preferably 0.4 mm. As shown in FIG. 2, the plate 4 has a cup-like tank forming swell portion 8 located at its one end, and a passage forming swell portion 9 contiguous to the section 8. The passage forming swell portion 9 is provided with a protruding junction 10 extending from between the two tank forming swell portions 8, when the two plates are joined together, up to the vicinity of the other end of the molded plate. Formed between the two tank forming swell portions 8 is a fitting recess 11 for a communication pipe which will be described later. The molded plate 4 has at its other end a projection (see FIG. 1A) provided for preventing the fin 2 from coming out during assembly prior to brazing. The tank forming swell portions 8 are larger in swelling (thickness) than the passage forming swell portions 9, one protruding junction 10 mating with the other upon joining the molded plates 4 together at their peripheries in such a manner that the heat exchange medium passage 7 is partitioned as far as the vicinity of the other element 3 to generally present a U-shape.

The tanks 5 of the adjacent tube elements 3 are abutted against each other at the tank forming swell portions 8 of their respective molded plates 4, and communicate with each other through communication holes 13 provided in the tank forming swell portions 8 except a blank tank 5*a* located substantially in the middle in the multilayered direction.

A tube element 3*a* at a predetermined offset position is not provided with the fitting recess 11, and its one tank 5*b* resting on the side having the blank tank 5*a* is elongated so as to approach the other tank. To this elongated tank 5*b* is connected a communication pipe 15 fitted into the fitting recess 11. A port generally designated at 16 is provided at one end far from the elongated tank 5*b*, of the opposite ends in the multilayered direction. The port 16 includes a connecting part 17 for the connection of an expansion valve, a communication passage 18 allowing the connecting part 17 to communicate with the tanks lying on the side having the blank tank, and a communication passage 19 associated with the communication pipe 15.

Figure 3:
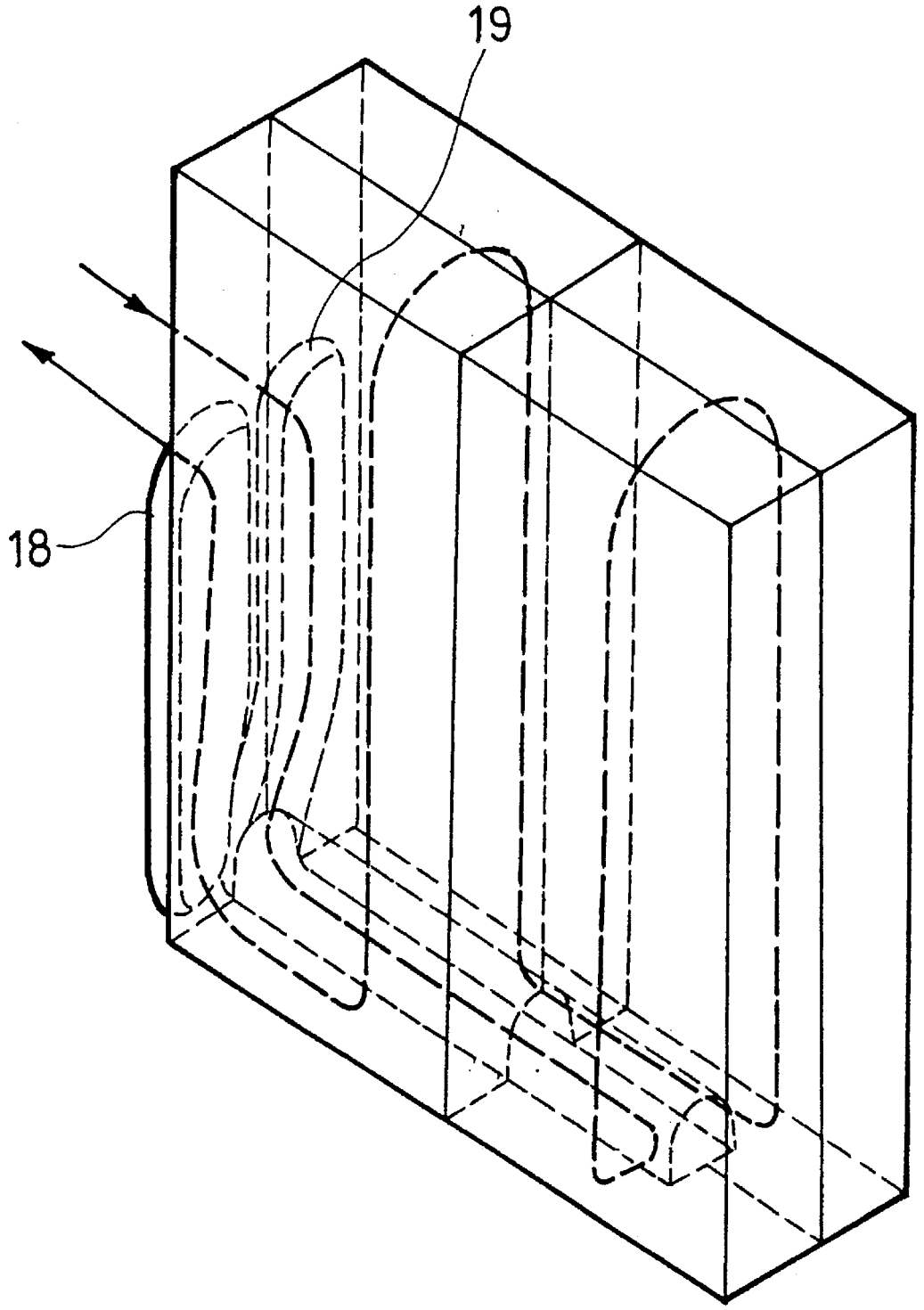
FIG. 3 is an explanatory diagram illustrating the flow of a heat exchange medium through the multilayered heat exchanger of FIG. 1.

Thus, assuming that a heat exchange medium is introduced through the communication passage 19 of the port 16, the introduced heat exchange medium flows by way of the communication pipe 15 and the elongated tank 5*b* into about half of the tanks lying on the side of the blank tank 5*a*, ascends therefrom within the heat exchange medium passage 7 along the partition defined by the confronting protruding junctions 10, descends with a U-turn around the tip of the partition 10, and reaches the corresponding tanks lying on the side opposite the blank tank 5*a*. Afterwards, the heat exchange medium is translated into the tanks of the remaining about half of the tube elements, and again move upward along the partition 10 within the heat exchange medium passage 7, followed by the downward movement with a U-turn around the tip of the partition 10, and finally exits via the communication passage 18 from the tanks 5 lying on the side having the blank tank 5*a* (see the flow in FIG. 3). As a result, heat of the heat exchange medium is transferred to the fins 2 in the process of flowing through the heat exchange medium passage 7, enabling the air passing through the space defined by the fins to be heat-exchanged.

Figure 4A:
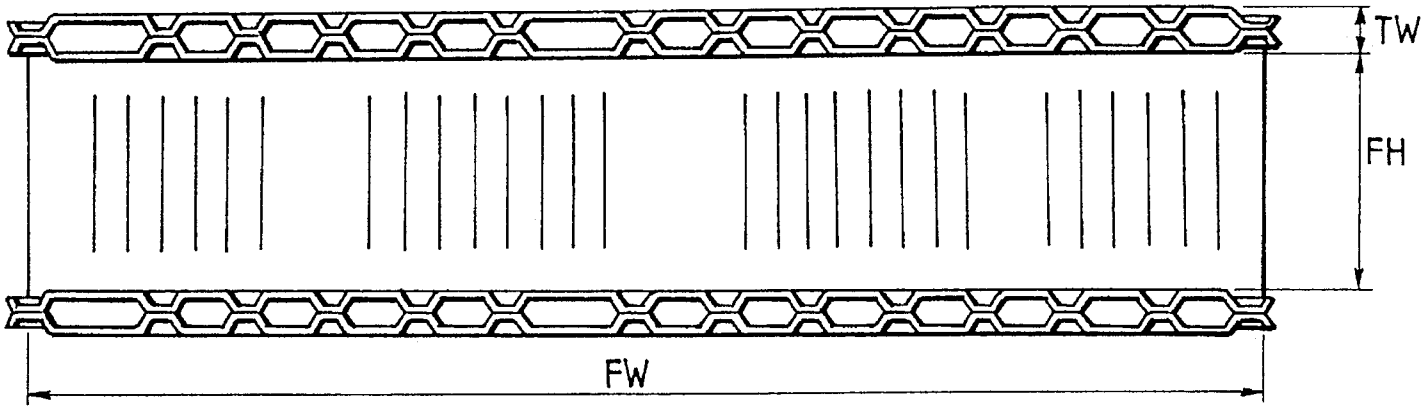
FIGS. 4A and 4B are explanatory diagrams illustrating fin width FW in the air-flow direction, fin thickness FT, fin pitch FP, fin height FH, and tube element thickness TW.
Figure 4B:
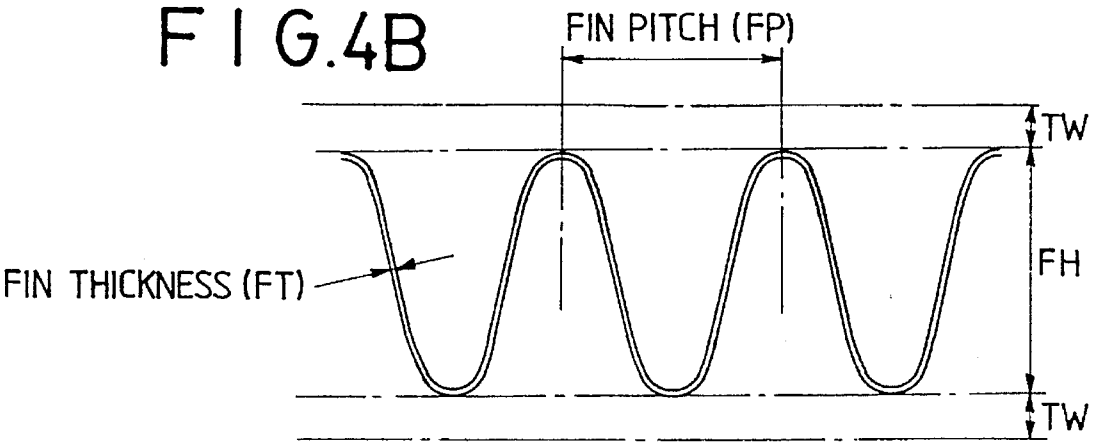

The fins 2 are corrugated and brazed on the external surfaces of the passage forming swell portions 9 of the tube element 3. With fin width FW in the air-flow direction, fin thickness FT, fin pitch FP, and fin height FH, as shown in FIGS. 4A and 4B, each fin 2 is formed to fulfill the relationships 50 mm$\leqq$FW$\leqq$65 mm, 0.06 mm$\leqq$FT$\leqq$0.10 mm, 2.5 mm $\leqq$FP$\leqq$3.6 mm, and 7.0 mm$\leqq$FH$\leqq$9.0 mm. Also, the thickness TW of the tube element 3 meets a relationship 2.0 mm$\leqq$ TW$\leqq$2.7 mm.

Generally, for a heat exchange performance, the higher the better, whereas for air-flow resistance of air passing between the tube elements 3, the less the better. It is to be appreciated that if the width of the fin 2 in the air-flow direction is smaller, the air-flow resistance tends to be lessened due to a smaller contact time with the fin 2, but the heat exchange performance will be accordingly lowered. On the contrary, if the width in the air-flow direction is larger, the heat exchange performance becomes satisfactory due to a larger contact time with the fin 2, but the air-flow resistance will be accordingly increased. Further, if the thickness of the fin 2 is diminished, the air-flow resistance and the heat conductivity are improved, but the overall heat exchange performance is lowered due to a smaller heat transfer area (sectional area of the fin). Reversely, if the thickness is built up, the heat exchange performance becomes satisfactory, but the air-flow resistance will be increased due to the buildup of thickness. As to the pitch of the fin 2, if it becomes large, the air-flow resistance is lessened with good draining properties, but the heat exchange performance is lowered due to the overall reduced surface area, whereas if smaller, the heat exchange performance becomes satisfactory by virtue of the overall enlarged entire surface area, but the air-flow resistance will be adversely increased. With regard to the height of the fin 2, the higher the fin 2, the greater the distance between the adjacent tube elements, resulting in less air-flow resistance but a poor heat exchange performance on the other hand, the lower the fin 2, the smaller the sectional area of the passage formed between the adjacent tube elements, resulting in good heat exchange performance, but in an increased air-flow resistance.

Further, a lessened thickness of the tube element will lead to an increased passage resistance within the tube, and hence less flow of the heat exchange medium passing there-through, resulting in a poor heat exchange performance, but less air-flow resistance since the flow of air will be less inhibited by the presence of the tube element. Reversely, the buildup of thickness will result in an increased flow of the heat exchange medium passing through the interior of the tube, which in turn contributes to the improvement in the heat exchange performance, but in a raised air-flow resistance since the air passage is narrowed by the presence of the tube elements. In view of the above, the ratio of the heat exchange performance to the air-flow resistance can be used as an index for evaluating a heat exchanger.

Figure 5:
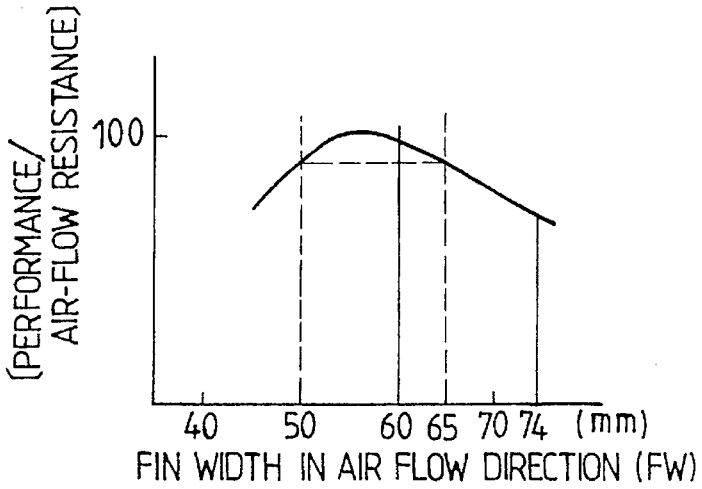
FIG. 5 depicts a characteristic curve representing variations in ratios of the heat exchange performance to the air-flow resistance, which may occur when changing the fin width FW in the air-flow direction.
Figure 6:
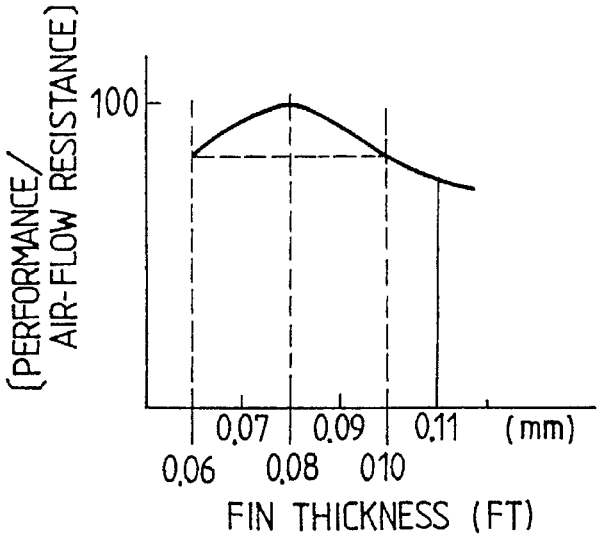
FIG. 6 depicts a characteristic curve representing variations in ratios of the heat exchange performance to the air-flow resistance, which may occur when changing the fin thickness FT.
Figure 7:
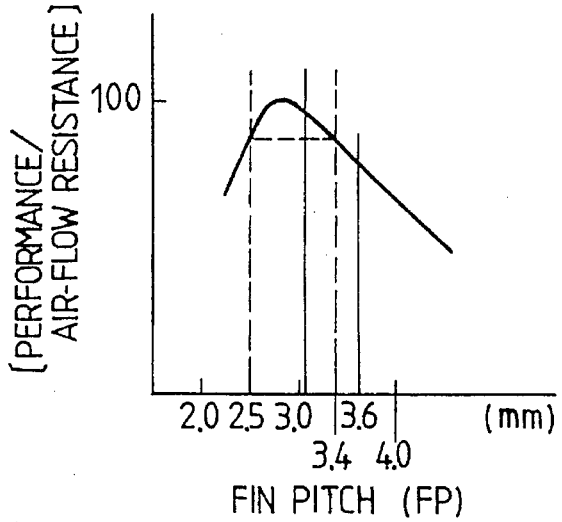
FIG. 7 depicts a characteristic curve representing variations in ratios of the heat exchange performance to the air-flow resistance, which may occur when changing the fin pitch FP.
Figure 8:
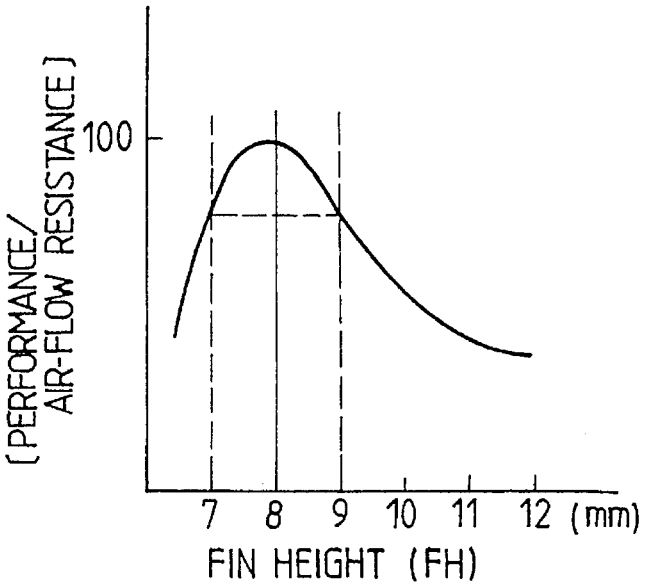
FIG. 8 depicts a characteristic curve representing variations in ratios of the heat exchange performance to the air-flow resistance, which may occur when changing the fin height FH.
Figure 9:
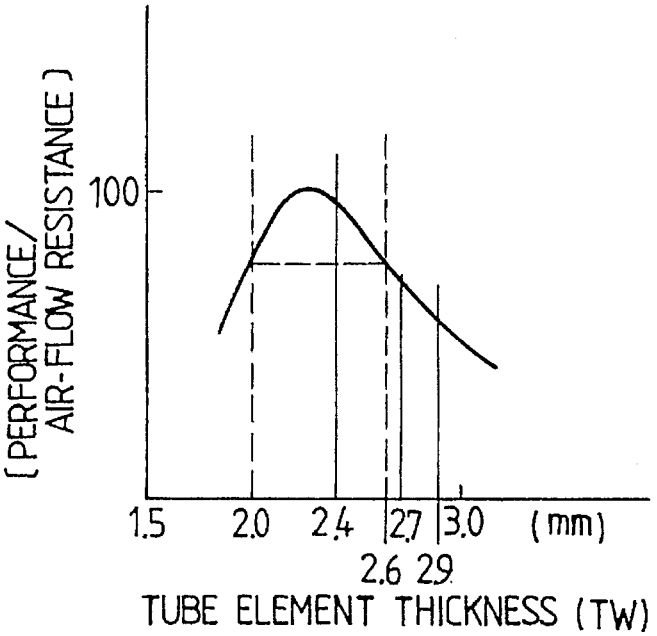
FIG. 9 depicts a characteristic curve representing variations in ratios of the heat exchange performance to the air-flow resistance, which may occur when changing the tube element thickness TW.

Thus, the heat exchanger may be evaluated with the axis of ordinates representing the heat exchange performance / air-flow resistance, and the axis of abscissas representing any one of the fin width FW in the air-flow direction, fin thickness FT, fin pitch FP, fin height FH, and tube element thickness TW. Standard dimensions of the heat exchanger were FW=60 mm, FT=0.08 mm, FP=3.1 mm, FH=8.0 mm, and TW=2.4. FIG. 5 depicts variations in the indices obtained when changing the width FW of the fin 2 in the air-flow direction, FIG. 6 depicts variations in the indices obtained when changing the fin thickness FT, FIG. 7 depicts variations in the indices obtained when changing the fin pitch FP, FIG. 8 depicts variations in the indices obtained when changing the fin height FH, and FIG. 9 depicts variations in the indices obtained when changing the tube element thickness TW.

The fin width FW in the air-flow direction, whose characteristic curve presents a peak of the index in the vicinity of 60 mm, must be 50 mm or over to ensure a conventional level of heat exchange amount. On the contrary, it is impossible to obtain a satisfactory index if the fin width is enlarged as far as 74 mm, a conventional bead size, since accordingly as the width becomes large, the air-flow resistance will be increased. Therefore, the upper limit of the fin width, if it is set on the basis of an index equivalent or superior to that corresponding to the lower limit of FW, will result in FW≦65 mm.

The fin thickness FT can range from 0.06 mm to 0.10 mm to obtain a good index, the index presenting its peak at about 0.08 mm. Accordingly as the fin thickness is lessened, the processing becomes harder and the heat transfer area is reduced, whereupon FT must be 0.06 mm or over. On the contrary, the upper limit of the fin thickness, if based on an index equivalent or superior to that corresponding to the lower limit of FT, will be FT≦0.10 mm, since a larger FT will lead to a better heat exchange efficiency, but to an increased air-flow resistance.

Then, the fin pitch FP, of which the characteristic curve presents a peak of the index in the vicinity of 3.0 mm, must be 2.5 mm or over in view of the practically allowable limit of the air-flow resistance since the smaller the fin pitch, the lower the air-flow resistance. Also, a larger FP will lead to less air-flow resistance, but to less heat exchange efficiency. Hence, the upper limit of the fin pitch, if set on the basis of an index equivalent or superior to that corresponding to the lower limit of FP, will result in FP≦3.4 mm. It is however practical for the use of the heat exchanger over a long period of time that FP should be 3.6 mm or below (for example, 3.5 mm), at the expense of a slight reduction in performance, from a viewpoint of improving the ability to drain condensate which may be produced between the fins (draining properties of the fin) or a viewpoint of curtailing the material cost. Thus, the fin pitch is preferably set within a range 2.5 mm≦FP ≦3.6 mm.

The fin height FH can range from 7.0 mm to 9.0 mm to obtain a good index, the index presenting its peak at about 8.0 mm. Since the smaller the fin height the greater the air-flow resistance, FH must be 7.0 mm or over in view of the practically allowable limit of the air-flow resistance. On the contrary, a larger FH will lead to less air-flow resistance, but to less heat exchange efficiency, and hence the upper limit of the fin height, if based on an index equivalent or superior to that corresponding to the lower limit of FH, will be FH≦9.0 mm.

Further, the tube element thickness TW, of which characteristic curve presents a peak in the vicinity of 2.3 mm, must be 2.0 mm or over in view of the practically allowable limit of the passage resistance since a smaller thickness will lead to a greater passage resistance within the tube through which the heat exchange medium passes. Also, a larger thickness will lead to less passage resistance but to greater air-flow resistance, whereupon the upper limit of the tube element thickness, if set on the basis of an index equivalent or superior to that corresponding to the lower limit of TW, will result in TW≦2.6 mm. It is to be noted that the upper limit of TW is practically 2.7 mm or below from a viewpoint of reducing passage resistance at the expense of a slight reduction in performance, or in view of a manufacturing error. It is therefore preferable that the tube element thickness TW be set within a range 2.0 mm≦ FP≦2.7 mm.

Thus, the fin and the tube element obtained within the above-described ranges are best suited for the improvement in the heat exchange efficiency as well as the reduction of the air-flow resistance. Accordingly, the use of the heat exchanger satisfying the above relationships will ensure a provision of a small-sized and lightweight heat exchanger as compared with the conventional ones.

While an illustrative and presently preferred embodiment of the present invention has been described in detail herein, it should be particularly understood that the inventive concepts may be otherwise variously embodied and employed without departing from the clear teaching of the disclosure and that the appended claims are intended to be construed to cover such variations except insofar as limited by the prior art.

What is claimed is:

1. A multilayered heat exchanger comprising a plurality of alternately layered fins and tube elements, each of said tube elements comprising:

a passage portion having a first end and a second end, and a junction wall extending from said first end and part way to said second end so as to define a U-shaped passage having first and second passage legs on opposite sides of said junction wall;

first and second tank portions provided at said first end of said, passage portion, said first tank portion being connected to said first passage leg, and said second tank portion being connected to said second passage leg; and an inlet port and an outlet port;

wherein said first tank portions of said plurality of tube elements, respectively, are aligned with one another, and said second tank portions of said plurality of tube elements, respectively, are aligned with one another;

wherein all of said first tank portions are successively fluidically connected to one another;

wherein a first successive group of said second tank portions are all successively fluidically connected to one another;

wherein a second successive group of said second tank portions are all successively fluidically connected to one another;

wherein a middle one of said second tank portions constitutes a blank tank portion and is interposed between said first group of said second tank portions and said second group of said second tank portions, such that said first group of said second tank portions is not directly fluidically connected to said second group of said second tank portions;

wherein, for all but one of said tube elements, said first and second tank portions are spaced apart from one another by given spaces, respectively;

wherein a communication pipe extends between a plurality of said first and second tank portions of said tube elements, respectively, through said given spaces thereof;

wherein for said one of said tube elements for which said first and second tank portions are not spaced apart by said given space, said first tank portion is elongated toward said second tank portion relative to a remainder of said first tank portions and is directly fluidically connected with said communication pipe; and, wherein one of said inlet port and said outlet port is directly fluidically connected with said communication pipe, and the other of said inlet port and said outlet port is directly fluidically connected to an endmost one of said second tank portions of said second group of said second tank portions.

2. A multilayered heat exchanger according to claim 1, wherein each of said tube elements comprises a pair of molded plates Joined together at their peripheries.

3. A multilayered heat exchanger according to claim 1, wherein wherein said fins and tube elements of said heat exchanger satisfy the relationships:

50 mm≦FW≦65 mm;

0.06 mm≦FT≦0.10 mm;

2.5 mm≦FP≦3.6 mm;

7.0 mm≦FH≦9.0 mm; and 2.0 mm≦TW≦2.7 mm;

wherein FW represents a width of said fin in the air-flow direction, FT a thickness of said fin, FP a pitch of said fin, FH a height of said fin, and TW a thickness of said tube element.

4. A multilayered heat exchanger according to claim 1 wherein wherein said fins and tube elements of said heat exchanger satisfy the relationships:

50 mm≦FW<64 mm;

0.06 mm≦FT<0.10 mm;

2.5 mm≦FP<3.4 mm:

7.0 mm≦FH<8.0 mm; and 2.0 mm≦TW≦2.7 mm;

wherein FW represents a width of said fin in the air-flow direction, FT a thickness of said fin, FP a pitch of said fin, FH a height of said fin, and TW a thickness of said tube element.

5. A multilayered heat exchanger according to claim 1, wherein said one of said inlet port and said outlet port which is directly fluidically connected with said communication pipe includes a first communication passage connected to said communication pipe, and a connecting part connected to said first communication passage for use in connecting said first communication passage to an expansion valve; and said other of said inlet port and said outlet port includes a second communication passage connected to said endmost one of said second tank portions of said second group of said second tank portions, and a connecting part connected to said second communication passage.

6. A multilayered heat exchanger according to claim 2, wherein each of said molded plates comprises an aluminum plate having a thickness of 0.25 to 0.45 mm.

* * * * *